US005951782A

United States Patent [19]

Truitt

[11] Patent Number: 5,951,782

[45] Date of Patent: Sep. 14, 1999

[54] BRUSHING APPARATUS AND METHOD

[76] Inventor: Archie Arthur Truitt, 119-33 Street West, Saskatoon, Saskatchewan, Canada, S7L 0T9

[21] Appl. No.: 08/763,298

[22] Filed: Dec. 10, 1996

[51] Int. Cl.[6] ..... A47L 11/282

[52] U.S. Cl. ..... 134/21; 15/340.4; 15/370; 15/383; 15/50.3

[58] Field of Search ..... 15/340.3, 340.4, 15/370, 383, 405, 50.3, 52.1, 74.2, 82, 87; 134/21

[56] References Cited

U.S. PATENT DOCUMENTS

| | | | |
|---|---|---|---|
| 1,211,902 | 1/1917 | Warner . | |
| 2,542,024 | 2/1951 | George et al. . | |
| 2,561,882 | 7/1951 | Patton . | |
| 3,189,932 | 6/1965 | Daneman . | |
| 3,222,706 | 12/1965 | Kaar et al. . | |
| 3,241,173 | 3/1966 | Finn . | |
| 3,284,831 | 11/1966 | Larsen . | |
| 3,453,678 | 7/1969 | Gehman et al. . | |
| 3,676,891 | 7/1972 | Murray et al. . | |
| 4,279,056 | 7/1981 | Jacobson, Jr. et al. . | |
| 4,363,157 | 12/1982 | McGrath . | |
| 4,685,228 | 8/1987 | Gisler et al. | 15/78 |
| 4,773,121 | 9/1988 | Young . | |
| 4,817,235 | 4/1989 | Doxey et al. . | |
| 5,249,332 | 10/1993 | Wilkerson . | |
| 5,426,805 | 6/1995 | Fisher . | |

FOREIGN PATENT DOCUMENTS

| | | | |
|---|---|---|---|
| 697720 | 1/1931 | France | 15/50.3 |
| 115836 | 1/1930 | Germany | 15/52.1 |
| 1703772 | 1/1992 | U.S.S.R. | 15/82 |

*Primary Examiner*—Frankie L. Stinson
*Attorney, Agent, or Firm*—Bereskin & Parr

[57] ABSTRACT

An apparatus, for brushing particulate material and the like from a surface, has a rotating brush, for example a cylindrical brush driven by hydraulic motor. The brush can be applied lightly to a surface and rotated relatively slowly, so as to brush material from the surface and project it forwardly. A strong air jet is provided in front of the brush and across the front of it, so as to pick up and entrain debris, snow, etc. brushed from the surface and blow or carry it laterally to one side. To dislodge material adhering to the bristles of the brush and prevent this from being carried behind it, a secondary, stripper nozzle is provided across the front of the brush for removing such material and causing it to drop in front of the brush. The apparatus enables the complete cleaning of a surface, for example an airport runway, in a single pass, and enables low brush pressure and speed to be provided, giving increased brush life.

18 Claims, 2 Drawing Sheets

BRUSHING APPARATUS AND METHOD

FIELD OF THE INVENTION

This invention relates to an apparatus for and a method of removing material from a surface. It more particularly is concerned with an apparatus for and a method of removing dirt and debris, and/or snow, ice and the like, from road surfaces, runways, and other paved surfaces.

BACKGROUND OF THE INVENTION

In modern, urban communities, there are large areas of paved surfaces. These can be found on ordinary roads, major highways, parking lots, airport runways and elsewhere. This poses a problem of keeping such surfaces clean of dirt and debris. In colder climates, there is a problem of maintaining them free of snow and ice.

For many roads and highways, natural flow of traffic ensures that no major items of debris can build up. Additionally, wind and rain have a naturally cleaning action and remove smaller dust particles and the like. For streets in built up urban areas, accumulation of litter can be a problem.

Cleaning of litter is often addressed by providing motorized vehicles with a variety of powered brushes. Commonly, there is one main brush, and then at least one additional auxiliary brush specifically adapted to clean the portion of the road surface adjacent the curb, where litter and debris tend to collect. Such vehicles rely primarily on a brushing action, although there are proposals in the art to provide vacuum assistance and sometimes washing with water is provided. As such, to ensure good cleaning, an aggressive brushing action is provided by rotating brushes at a relatively high speed and maintaining the brushes pressed against these surfaces with a relatively high force. While this can be effective in cleaning a surface, it leads to a high power requirement and rapid wear of the brushes.

A related problem is clearing ice and snow, which can be a problem on any exterior car paved surface. A continuous sheet of ice presents an almost intractable problem, and usually can only readily be dealt with by application of salt or other materials to cause the ice to melt. For snow, or ice that is in powdery or loose form, there is the possibility of removing this mechanically.

For ordinary roads, snow plows, or snow blowers are commonly used for snow, or ice pellet accumulations, of any significant magnitude. For roads, this more than adequately cleans the road, although usually a thin layer of snow or ice pellets is left, often slightly compacted. Ordinary road vehicles can readily deal with such a thin layer of snow or ice and obtain adequate traction.

Airport runways present different problems. Firstly, aircraft travel at far greater speeds than ordinary motorized vehicles, yet usually are fitted with tires that provide worse traction capabilities. Consequently, any significant accumulation of snow or ice can cause considerable difficulties for aircraft landing and taking off. This can result in poor braking ability of an aircraft, skidding, loosing control and leaving runways.

An additional problem is provided by aircraft engines. Ordinary aircraft engines, such as jet engines, are extremely powerful, and require vast quantities of air. As such, a jet engine and the like, can create a strong suction at its inlet, and correspondingly produce a very strong jet at the outlet.

For takeoff, when an aircraft's engines are typically open to full throttle, this presents the possibility of debris on runways being sucked into the engines, possibly damaging the engines. Similarly, the jet at the outlet of the engine can pick up debris from the ground and cause it to be thrown large distances. Such debris can possibly impact vehicles, other aircraft or bystanders causing injury or damage.

For all these reasons, it is highly desirable to maintain airport runways in as clean a condition as possible. Conventional runway sweepers typically comprise a large cylindrical brush mounted at the front end of a truck or the like. The truck is run up and down the runway in various patterns, for the removal of dirt, debris, snow or whatever material is present. This again presents the same problems as conventional road sweepers, as typically the brush is rotated at a fairly fast rate with the intention of throwing swept materials some distance and discouraging material from clinging to the bristles of the rotating broom or brush.

Even so, it has been recognized that one of the problems of the simple cylindrical brush is that some pieces of debris or other material may cling to the brush for a short time and then fall down behind the brush. A proposed solution to this is to provide some sort of air duct along the back of the brush to blow away this debris. Nonetheless, the main cleaning effect is still provided by the brush, and as for conventional road sweepers, there is a problem of providing power to rotate the brush at a reasonable speed and relatively rapid wear rate of the brush.

U.S. patents in this art that disclose cleaning or sweeping arrangements, known to the applicant are:

| U.S. Pat. No. | Patentee |
|---|---|
| 3,189,932 | B. Daneman |
| 3,222,706 | K. B. Kaar et al |
| 5,249,332 | Wilkerson |
| 1,211,902 | F. L. Warner |
| 4,773,121 | Young |
| 3,676,891 | Murray et al |
| 3,241,173 | C. O. Finn |

A number of these patents show arrangements provided with brushes combined with some sort of vacuum assistance. Thus the Daneman, Kaar et al, and Wilkerson patents all disclose arrangements which have some combination of brushes and a vacuum arrangement. A common characteristic of these arrangements is that the airflow is always used in a suction mode.

The Warner and Young patents are of some similarity, and they both show some sort of pickup device in which air is directed at a surface and a corresponding suction duct is provided. Again, the basis intention is removal of dirt or debris by a suction effect.

A vacuum machine for street cleaning is disclosed in the Murray et al patent, which provides flinger blades, intended to encourage air to flow under leaves or debris, so that they can be removed by suction.

The Finn patent discloses a so-called multi-purpose device, although it is primarily intended for use in seeding, fertilizing and like agricultural applications. One configuration is shown in which it is arranged to provide a horizontal air blast, e.g. for use as a wind drawing device. However, this is independent of any brushing arrangement.

Another known proposal provides an air blast behind a rotating brush. The intention is to clear away any debris that may fall off the back of the brush. The common arrangement is to provide a fairly modest airflow, of the order of 6–9,000 cfm. To achieve adequate velocity, this is then passed through a small outlet with a diameter of 4–6 inches. While the velocity at the outlet may be adequate, this produces a jet or blast that is too small to be adequate and which dissipates too quickly. This has not proven effective in removing debris that falls down behind a brush, so that commonly two or more passes must be made to achieve adequate cleaning or brushing of a surface.

SUMMARY OF THE INVENTION

Accordingly, in this art, there is a strong need for a technique which will enable material, such as dirt, debris, snow or ice pellets, to be removed from a paved surface, the technique should ensure efficient and complete cleaning of the surface, without having any problems due to residual material falling off the back of any brushes or the like. To the extent that brushes are required to implement the technique, brushing speeds should desirably be maintained low and brush pressure light, so as to increase the life of the brushes. The technique should preferably project removed materials some considerable distance, so as to prevent accumulation of the materials in substantial banks, e.g. when snow clearing. Such banks merely present barriers to subsequent cleaning of the surface, and encourage drifting of the snow onto the paved surface, e.g. runway, which it is desired to be kept clean.

In accordance with the present invention, there is provided an apparatus, for removing material from a surface, the apparatus comprising:

- a brush means mounted for rotation for brushing material forwardly of the apparatus in the direction of the path;
- drive means for rotating the brush means;
- an outlet nozzle mounted adjacent the brush means, for providing an air jet traversely across the front of the brush means;
- air supply means connected to the nozzle for delivering air to the nozzle, whereby, in use, material on the surface is displaced forwardly in front of the brush means, and is entrained in the air jet, so as to be carried away from the path.

In accordance with another aspect of the present invention, there is provided a corresponding method. The method comprises steps of:

- rotating a brush and advancing the brush forwardly along a path across a surface with the brush contacting the surface so as to brush material off the surface and forwardly of the brush;
- providing an air jet traversely across the front of the brush and adjacent to the surface whereby material brushed forwardly by the brush is entrained in the air jet and carried away from the path.

For most applications, it is anticipated that a cylindrical brush rotated about a generally horizontal axis will be preferred. For some applications, it may be desirable to include, either alternatively or as well, one or more individual brushes mounted for rotation about an inclined vertical axis so that just one side of the brush contacts the ground, the axis being inclined so that the brush projects material forwardly.

While the present invention should ensure good removal of material thrown up or brushed forwardly by the brush, it is nonetheless recognized that there may still be the problem of some material or particles adhering to the bristles of the brush. Such material adhered to the bristles anywhere inwardly from the surface of the brush will likely not be affected by the air blast or jet. As such, as with conventional arrangements, the adhered material may be carried around to the rear of the brush before falling to the ground, i.e. before falling on the portion of the path that has just been cleaned.

In accordance with the present invention, to overcome this problem, it is preferred to provide an additional stripping nozzle. This nozzle can be in the form of an elongate slot-shaped nozzle extending outwardly from an elongate duct mounted parallel to and in front of the brush and above the air jet. This slot-shaped nozzle is preferably in accordance with my earlier U.S. Pat. No. 5,468,185, the contents of which are hereby incorporated by reference. The slot-shaped nozzle is supplied with air from the same air source that supplies the main nozzle outlet.

Material that can be removed by the apparatus and method of the present invention includes any particulate material, such as dirt, stones or the debris, snow, ice pellets or the like. It also includes common debris found on city streets, such as papers, discarded fast food containers, and any other material that can be readily picked up by a brush and entrained in an air flow. It will be appreciated that the extent to which material can be entrained will depend upon various facts, including its shape, size and density. Thus, lightweight, sheet materials can be readily entrained, while larger stones or pebbles will be difficult to entrain and carry for any substantial distance. Depending upon the application, the velocity of the air jet can be selected so that materials of interest or adequately entrained and carried away from the front of the brush.

BRIEF DESCRIPTION OF THE DRAWING FIGURES

For better understanding of the present invention and to show more clearly how it may be carried into effect, reference will now be made, by way of example to the accompanying drawings, to show a preferred embodiment of the present invention and in which.

DESCRIPTION OF THE PREFERRED EMBODIMENT

Figure 1:
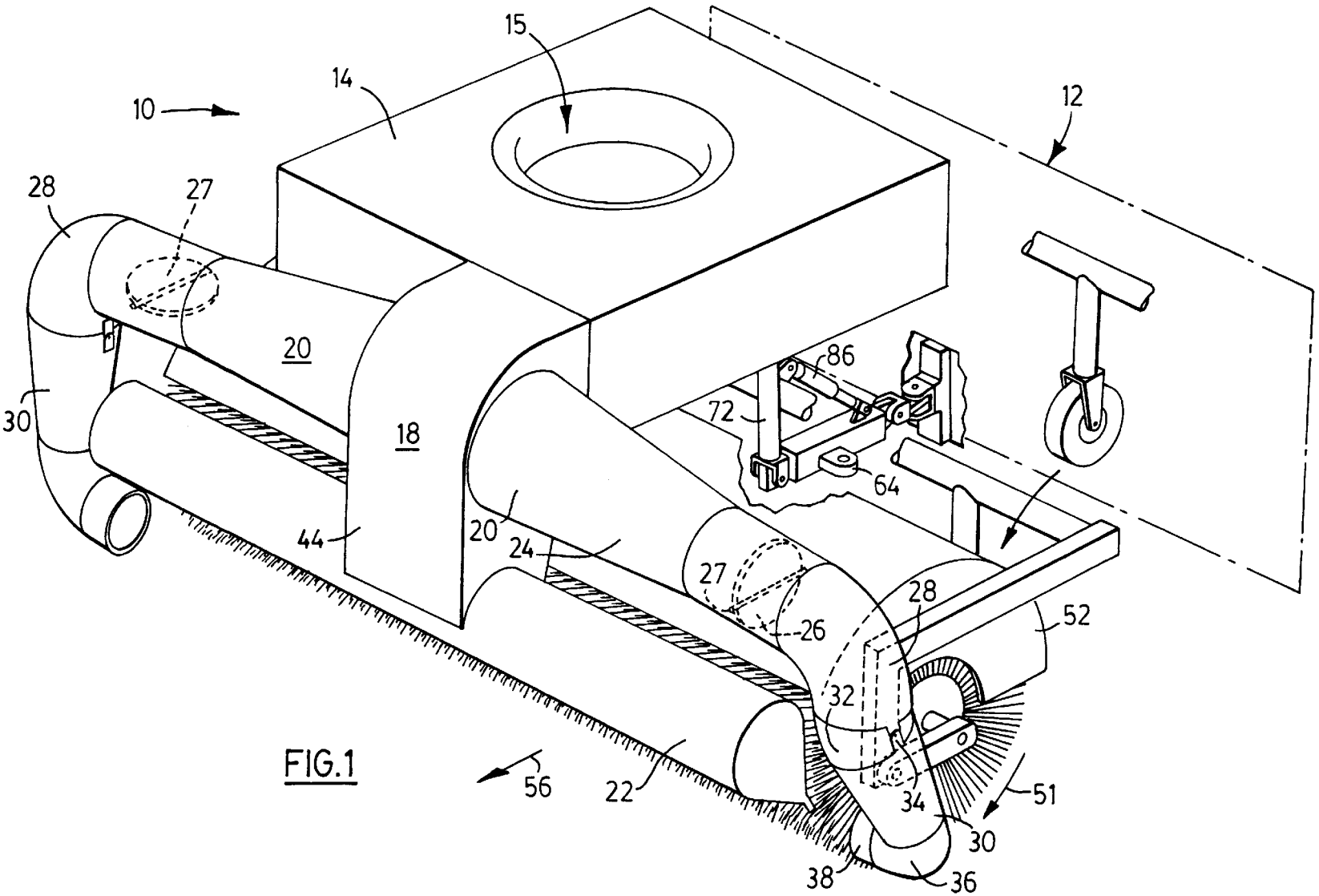
FIG. 1 is a perspective view of an apparatus according to the present invention.
Figure 2:
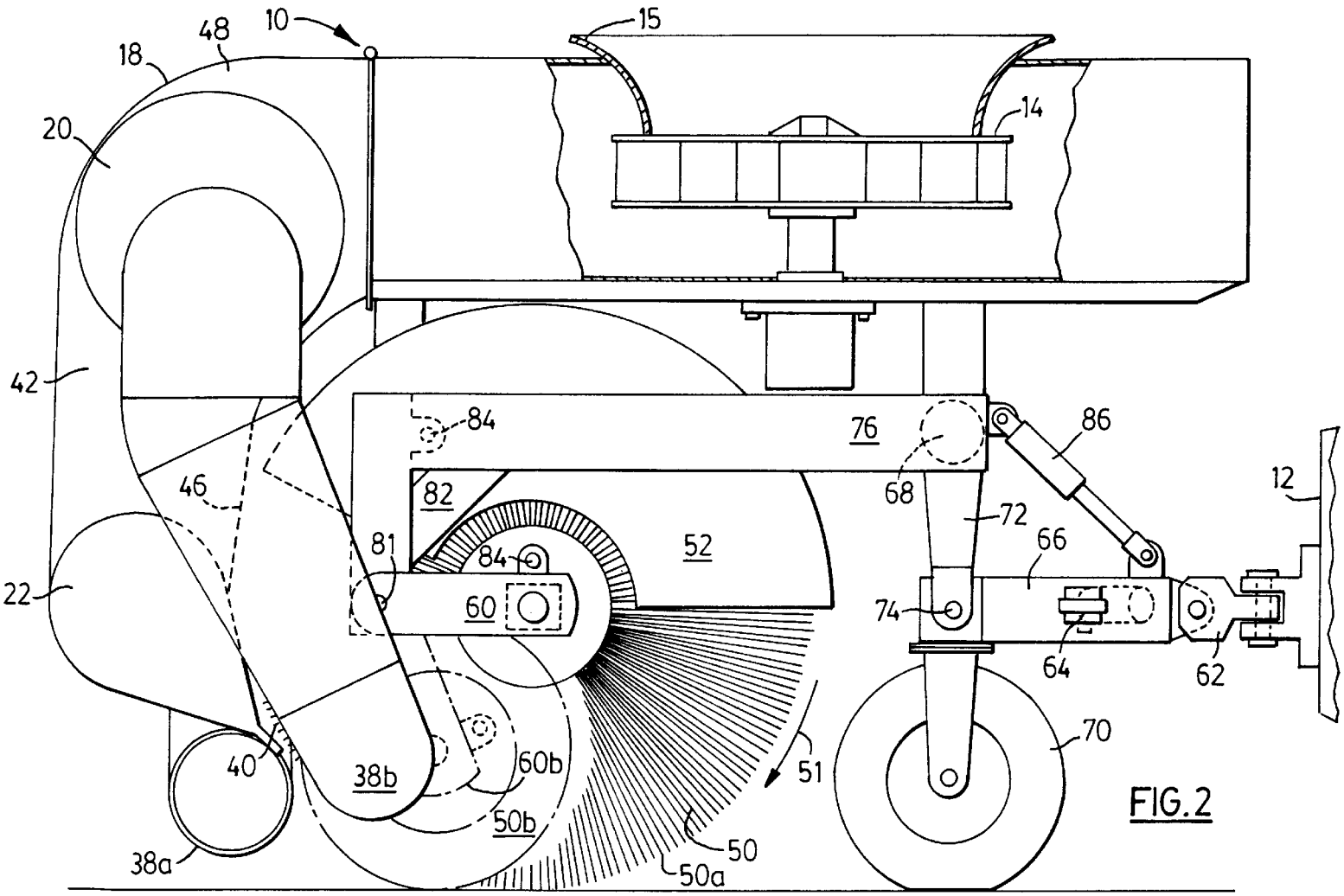
FIG. 2 is a side view of the apparatus of FIG. 1.

In the drawings, an apparatus in accordance with the presence invention is indicated generally by the reference 10, and is shown mounted on a tractor 12, the front of which is shown schematically at 12 in FIG. 2. The apparatus 10 includes a fan 14, provided with an upper inlet 15, which is aerodynamically smooth and streamlined. Optionally, it could include a second, lower inlet. Shown for purposes of illustration is a fan unit 14 with a nine foot diameter and a nominal capacity of 12,000 cfm.

At the front of the fan unit 14, there is a manifold 18, which distributes the air to two main side ducts 20 and a secondary distribution duct 22. The structures of the two main side ducts 20 are essentially symmetrical.

Each main side duct 20 has a first portion 24 that tapers down from a large diameter to a small diameter, and continues into a second portion 26 which is generally cylindrical. Butterfly valves 27 are provided in the portions 26, to enable the side ducts 20 to be selectively closed off. This portion 26 in turn continues through an upper elbow 28.

Below each elbow 28, there is a downwardly extending leg portion 30, which again tapers in cross-section. The leg portion 30 is connected to the elbow 28 by a bellows 32. The bellows 32 enable the leg portion 30 to be swung backwards and forwards, as detailed below. To constrain the leg portion to move as desired, a hinge mechanism 34 is provided.

At the bottom of the leg portion 30 there is a lower elbow 36 which again turns through 90 degrees and continues to an outlet nozzle 38, directed horizontally. As the diameter is considerably reduced at the elbow 36, the velocity is correspondingly increased. To allow for this, and in known manner, fins are provided in the elbow 38 dividing the flow into three flows.

The secondary distribution duct 22 is generally cylindrical and elongate. As shown, along one edge, it includes an elongate slot-shaped nozzle 40. The nozzle 40 can have a width that increases progressively away from the manifold 18, and is provided with fins (not shown) to direct the air flow from the duct 22 uniformly out through the nozzle 40. This nozzle 40 can be in accordance with my earlier U.S. Pat. No. 5,468,185 the contents of which are incorporated by reference.

As shown, the manifold 18 essentially comprises flat sides 42, a flat front surface 44, and rear surface 46 that is partially curved. It includes an arcuate or curved portion 48 at the top thereof, to promote smooth flow of the air. Again, appropriate finning can be provided in the manifold 18, to direct the flow into the main side ducts 20 and the secondary duct 22.

Mounted below the fan unit 14 is a cylindrical brush 50. As shown, the brush 50 has a diameter of 47" for example, and a location 50*a* when new. It is mounted for rotation about its axis and a suitable hydraulic drive motor indicated schematically at 58 in FIG. 2. As the brush wears, its diameter reduces, and the diameter of a worn broom, e.g. a diameter of 18 inches is shown at 50*b*. As detailed below, the mounting of the broom or brush 50 is such that this axis drops down and moves forward as it wears. This is achieved by providing mounting arms 60 pivotally secured at a forward end thereof, with the broom or brush pivotally mounted to the rearward ends of the arms 60. As the arms are initially horizontal, as the brush 50 wears, the rearward ends will naturally drop downward and move forward. As detailed below, this has the advantage that the forward side of the brush remains in a relatively constant position, so that an air blast in front of it does not have to be displaced forwardly or rearwardly by any large amount.

In known manner, a shroud is provided above the brush 50. The shroud is indicated generally at 52. The shroud 52 is fixed, although it could be moveable to accommodate wear of the brush 50.

Referring to FIG. 2, this shows the frame of the apparatus and its mounting to the front end of a conventional tractor 12. As shown at 62, a connection to the tractor or other drive unit is made by way of a connector 62 providing pivotal movement about both horizontal and vertical axis. As shown at 64 a side connection can be provided, for connecting an hydraulic cylinder and piston, to effectively steer the apparatus and cause it to pivot about the vertical axis. The horizontal axis or pin ensures that no weight of the apparatus is taken by the tractor unit.

A rear frame member 66 extends forwardly from the connector 62 to a lower end of one vertical leg 72, which extends up to a cross member 68. Mounted on the cross member 68, there are a pair of support wheels 70, which are spaced horizontally apart. The support wheels 70 can be caster wheels.

There are two upwardly extending legs 72, which extend upwardly from the cross member 68 and are pivotally connected thereto as indicated at 74. The reason for this pivot connection are given below. Two side arms 76 are secured to ends of the cross member 68 and extend forwardly. The fan 14 and associated ducts for air flow are supported on the upper ends of the legs 72 and additional upwardly extending support brackets 78, which are mounted on the shroud 52.

At a forward end of the side arms 76, there are a pair of forward leg members 80 extending downwardly and braced by gussets 82.

The mounting arms 60 are pivotally attached at 81 to the lower ends of the forward leg members 80. As indicated at 84, on either side, there are a pair of mounting eyes, for hydraulic piston and cylinder assembly, one end of which, effectively, acts on the shaft supporting the brush 50, so that the pressure that the brush applies to the ground surface can be varied.

Corresponding to the positions 50*a*, 50*b* for the new and worn brush, the mounting arm 60 are shown, for an arm, in a position 60*a* for a new brush and a position 60*b* for a worn brush. It can be noted that the effective radius of the arms 60 is substantially less that the radius of a new brush 50, and approximately equal to, although slightly greater than, the radius of a worn brush 50*b*. As FIG. 2 shows, this arrangement of the mounting arm 60 enables the slot-shaped nozzles 40 to be in a correct position for cleaning the front of the brush for all diameters of the brush.

An additional hydraulic piston and cylinder assembly 86 is provided at the rear, between one leg 72 and the rear frame member 66. This enables the main part of the apparatus to be pivoted relative to the rear frame member 66, to lift the brush 50 off the ground for transportation purposes. The weight of the apparatus is then taken on the support wheels 70.

It is also preferred, in the present invention, to use a solid core broom or bush. A solid core brush has continuous disks of bristles. A brush without a solid core has spaces between individual disks of bristles, with, for example, a one and a quarter inch spacing between each disk.

Now, in use, the brush is moved in the direction of arrow 56 along a path and is rotated in the direction of the arrows 51, so as to lift generally particulate material, such as dirt, debris, snow or the like from the surface and project the material upwards and forwardly. With conventional brushes, the brush is intended to both remove material from the immediate surface and project it forwardly with sufficient energy that it is effectively removed. To this end, conventional brushes are usually rotated at a relatively high velocity and are pressed against the surface with a relatively high pressure.

For example, many conventional rotating brushes used for clearing runways and the like typically rotate at speeds in the range of 525 to 740 rpm, although it is believed that some newer machines even have rotational speeds as high as 900 rpm. Current specifications, for example those of Transport Canada known to the applicant, require a pressure of four–six inches pressing the brush against the surface. This specification of 4–6 inches is a measure of how far ends of the bristles are deflected from a rest position. With these conditions, relatively short brush life, commonly of the order of 65 hours, is achieved. Additionally, cleaning of a runway or other surface is not effectively achieved in one pass, so that two or three passes are required.

In accordance with the present invention, the brush is solely required to displace material from the surface sufficiently that it becomes airborne or raised from the surface to a certain extent, so that it can be entrained in a strong airflow. For this purpose, the brush is rotated at a relatively low speed, for example around 250 rpm, and possibly as low as 60 rpm. The rotational speed of the brush will depend upon the material being swept away, and the diameter of the brush etc., as is known. Additionally, the brush is pressed against the surface with a relatively low pressure of one half to one inch. The effect of this is cause any material picked up by the brush to be projected forwardly sufficient to be picked up by an airflow, detailed below. The stronger pressure applied by conventional brushes is intended to provide significant forward projection of material, but often results in the material being thrown upwardly rather than forwardly.

The second step in the method of the present invention is, simultaneously, to provide an air blast or jet traversely across the front of the brush 50, from one side thereof. As shown, there are two outlet nozzles 38, designated 38*a*, 38*b*. For travel in one direction one outlet nozzle, for example the nozzle 38*a*, would be positioned to provide the jet. So as not to obstruct the flow from this nozzle, the other nozzle 38*b* would be swung backwards out of the way, as shown in the drawing.

For cleaning runways and other large areas, a typical brushing pattern involves travelling from side to side of the runway, first in one direction and then the other. To ensure that the snow or other material is always blown in the same direction, nozzle 38*a* is used in one direction and the nozzle 38*b* in the other direction. The butterfly valves 27 are actuated so that air flows only to the nozzle 38 in front of the brush and air is shut off to the nozzle that is held back.

Thus, the fan unit 14 is operated so as to provide the desired flow rate. As detailed below, for specific dimensions and usages, the velocity of the air should be in excess of 200 miles an hour, preferably in excess of 250 miles an hour, and more preferably in excess of 300 miles an hour. The effect of this is to cause, for most applications, 90 per cent of the debris to be removed from in front of the brush 50.

Thus the brush 50 reaches each portion of the surface after it has been blasted with an air jet. The brush 50 removes any remaining debris or material by a brushing action and throws this up into the path of the jet or blast from the nozzle 38, so that it is entrained in the air.

With the flow velocities mentioned, it has been found that common debris will be carried 25 to 30 feet to the side of the apparatus. Heavier material such as slush and the like may only carry in the range of 15–20 feet, while light, powdery snow can be blown 35 feet or further. This prevents accumulation of snow into high banks.

A third important step of the method is the provision of a secondary air flow from the slot-shaped nozzle 40. Some material or debris may tend to cling to the bristles of the brush 50, and then fall down behind it. This, clearly, would then fall on the just-cleaned surface. To ensure that the surface is fully cleaned and that no secondary passes are required, the blast from the nozzle 40 cleans the bristles, by removing any debris clinging to them and blowing it down into the main jet from the nozzle 38.

With regard to exemplary dimensions, the brush 50 typically may have a diameter in the range of 30–47 inches when new. As mentioned, it should be a solid core broom, not be provided with spaces. The broom may have a variety of lengths, with lengths of 9 feet, 14 feet and 22 feet, being commonly available.

For the 9 foot and 14 foot length brooms, air velocity of 22,000 f.p.m. (250 m.p.h.) is sufficient. The outlet nozzle 38 would then have a diameter of 8 inches, so that the c.f.m. required for the nozzle would be approximately 7675 c.f.m. The air distribution or slot-shaped nozzle 40 would then require an airflow of 2700 c.f.m. for the 9 ft brush and 4125 c.f.m. for the 14 ft brush, for totals, rounded, of 10,500 c.f.m. and 12,000 c.f.m. The first portions 24 of the main side ducts 20 would have a diameter of 18 inches, and this diameter would be reduced down though a portion of 12 inches to the outlet nozzle at 8 inches diameter. For the 14 foot broom, this 18 inch diameter would be reduced progressively to allow for the longer length, down to 16 inches, 10 inches and then to the 8 inch nozzle.

For a 22 foot broom, air would be supplied at approximately 31,000 f.p.m. (350 m.p.h.). The outlet nozzles 38 would then have diameters of 10 inches, and the air flow total would be approximately, 26,000 c.f.m. 17,000 c.f.m. would go to the nozzle 38 and 9,000 c.f.m. to the slot-shaped nozzle 40.

As to the slot-shaped nozzle 40, this has a width of 0.25", but any suitable width could be used. It could, for example, have a width in the range 0.125–0.3125". The exit velocity from this nozzle will essentially be the same as from the nozzles 38.

As observed above, the brush 50 can be operated at speeds of 60 to 250 rpm and have a brush pressure in the range of one-half to one inch. This has been found to increase the broom life significantly, possibly by a factor of four or greater. Additionally, as all material on the surface can be cleared in one pass, fewer passes are required.

While a preferred embodiment of the invention has been described, it will be appreciated that various modifications are possible within the scope of the present invention. In particular, while the apparatus has been described with the frame intended for the mounting apparatus in front of a tractor or drive unit, it is equally possible that the frame could be configured to enable the apparatus to be towed. It will be appreciated by those skilled in the art that this simply requires providing an extension of the frame in front of the various ducts and a coupling arrangement at the front thereof.

I claim:

1. An apparatus, for removing material from a surface by movement in a forward direction along a path, the apparatus comprising:

(a) brush means mounted for rotation, for brushing material forwardly from the apparatus in the direction of the path;

(b) drive means for rotating the brush means;

(c) an outlet nozzle mounted adjacent the brush means, for providing an air jet passing transversely across the front of the brush means; and (d) air supply means connected to the nozzle for delivering air to the nozzle, whereby, in use, material is displaced from the surface forwardly in front of the brush means, and is entrained in the air jet so as to be carried away from the path, wherein the brush means is generally elongate and is mounted for rotation about an axis spaced above the path, wherein the apparatus includes two outlet nozzles, each of which is mounted adjacent a respective end of the brush means with the nozzles directed towards one another, and wherein the outlet nozzles are movably mounted between forward and rearward positions, whereby one outlet nozzle can be positioned in the forward position directed across in front of the brush means and the other outlet nozzle can be positioned in the rearward position so as not to obstruct the jet and airflow generated by said one outlet nozzle.

2. An apparatus claimed in claim 1 wherein the brush means is generally cylindrical, and is mounted to accommodate wear of the brush means wherein the apparatus further includes side duct means connecting the air supply means to the nozzle outlets, each side duct means extending outwardly from the air supply means and including a leg portion extending generally downwardly, each of which leg portions includes hinge means enabling the nozzle outlet attached thereto to pivot between the forward and rearward positions.

3. An apparatus as claimed in claim 2, wherein the brush means is generally cylindrical and is mounted so that as the brush means wears and reduces in diameter in use, the forward surface of the brush means remains in substantially the same location relative to the nozzle outlets.

4. An apparatus as claimed in claim 3, wherein the apparatus includes a frame, a pair of mounting arms extending forwardly from the brush means and being pivotally attached to the frame.

5. An apparatus as claimed in claim 4, wherein the mounting arms have a radius that is less than the radius of a new brush means and greater than the minimum acceptable radius for the brush means, the mounting arms extending generally horizontally for a new brush means.

6. An apparatus as claimed in claim 1, which includes a secondary distribution duct connected to the air supply means and an elongate slot-shaped nozzle connected to the secondary distribution duct, and mounted to provide a second airflow downwardly across the front of the brush means, for removal of material adhering to the brush means.

7. An apparatus as claimed in claim 6, wherein the brush means is generally elongate and is mounted for rotation about an axis spaced above the path, and wherein the apparatus includes two outlet nozzles, each of which is mounted adjacent a respective end of the brush means with the nozzles directed towards one another, wherein the outlet nozzles are movably mounted between forward and rearward positions, whereby one outlet nozzle can be positioned in the forward position directed across in front of the brush means and the other outlet nozzle can be positioned in the rearward position so as not to obstruct the jet and airflow generated by said one outlet nozzle.

8. An apparatus as claimed in claim 7, wherein the air supply means is generally centrally mounted and includes fan means having an inlet for ambient air and an outlet, an air distribution manifold connected to the outlet of the fan means and connected to the secondary distribution duct, and a pair of main side ducts extending outwardly from the manifold to the nozzle outlets.

9. An apparatus as claimed in claim 8, wherein each of the main side ducts comprises first portion extending generally horizontally outwardly and a leg portion extending downwardly, each of which leg portions includes hinge means enabling the nozzle outlets to be moved between the forward and rearward positions.

10. An apparatus as claimed in claim 9, wherein each of the main side ducts includes valve means, enabling one of the side ducts to be closed off and the other open, to enable selective supply of air to one of the nozzle outlets.

11. An apparatus as claimed in claim 10, wherein each of the main side ducts comprises a first portion that tapers downwardly from a relatively large cross-section to a small cross-section, a second, generally cylindrical portion extending outwardly from the first portion, an upper elbow extending through approximately 90 degrees and directing flow from the second portion from a horizontal direction to a downward direction, a generally tapered leg portion which tapers from a relatively large diameter to a relatively small diameter, a hinge mechanism including bellows connecting the upper elbow to the leg portion, a lower elbow connected to the lower end of the leg portion and diverting the flow from a downward direction to a horizontal direction across the front of the brush means, and one of the nozzle outlets connected to the lower elbow.

12. A method of removing material from a surface, the method comprising the steps of:

(a) moving a brush means along the surface along a path;

(b) rotating the brush means about an axis extending above the surface and against the surface in a direction causing material on the surface to be removed and brushed forwardly;

(c) simultaneously providing a jet of air traversely across the front of the brush means whereby material brushed forwardly by the brush means is entrained in the air jet and carried away from the path, wherein the path comprises portions extending in one direction across the surface alternating with portions extending in another, opposite direction across the surface, wherein the method comprises, for movement in said one direction, providing an air jet across the front of the brush means from one end thereof, and for movement in the other direction, providing an air jet across the brush means from the other end thereof.

13. A method as claimed in claim 12, wherein the air jets are provided by nozzle outlets, and wherein to provide a jet, one nozzle outlet is positioned forwardly in front of the brush means and the other nozzle outlet is withdrawn rearwardly so as not to obstruct the jet generator.

14. A method as claimed in claim 13, wherein air is supplied to the nozzle outlets from a common air supply means, wherein air is supplied to said one nozzle outlet positioned forwardly with the air supplied to the nozzle outlet withdrawn rearwardly being shut off.

15. A method as claimed in claim 14, wherein the air jets are provided through nozzle outlets having a diameter of at least 8 inches and an air velocity of at least 250 miles per hour.

16. A method as claimed in claim 15, wherein air is supplied through nozzle outlets having a diameter of at least 10 inches and an air velocity of at least 350 miles per hour.

17. A method as claimed in claim 12, wherein the brush means is generally cylindrical and is rotated at a speed in the range 60–250 revolutions per minutes with a brush pressure in the range one half—one inch.

18. A method as claimed in claim 17, which includes providing a secondary air flow from a slot-shaped nozzle across the forward surface of the brush means, to displace material adhering to the brush means in front of brush means.

* * * * *